United States Patent [19]

Nomiyama

[11] 4,012,794

[45] Mar. 22, 1977

[54] IMPACT-ABSORBING HELMET

[76] Inventor: Tetsuo Nomiyama, 1526 Century, Santa Ana, Calif. 92703

[22] Filed: Aug. 13, 1975

[21] Appl. No.: 604,358

[52] U.S. Cl. ..... 2/411; 2/6

[51] Int. Cl.[2] ..... A42B 1/08

[58] Field of Search ..... 2/3 R, 6

[56] References Cited

UNITED STATES PATENTS

| | | | |
|---|---|---|---|
| 2,625,683 | 1/1953 | Roth et al. | 2/6 |
| 3,616,463 | 11/1971 | Theodore et al. | 2/3 R |

FOREIGN PATENTS OR APPLICATIONS

| | | | |
|---|---|---|---|
| 147,914 | 11/1936 | Austria | 2/6 |
| 1,113,432 | 3/1956 | France | 2/3 R |
| 12,765 | 1915 | United Kingdom | 2/3 R |

*Primary Examiner*—Alfred R. Guest

[57] ABSTRACT

An impact-absorbing helmet comprising an inner, substantially-stationary, shell member formed as an integral part of the base member, including a separate outer shell member superposed over the inner shell member and rotatably attached thereto, the rotation thereof being about the vertical axis of the helmet, whereby any tangential impact received by the outer shell will cause the outer shell to rotate, thereby absorbing the blow thereto, wherein the outer shell is held in rotational, spaced relationship by a plurality of bearing units interdisposed therebetween.

7 Claims, 11 Drawing Figures

FIG. 9.
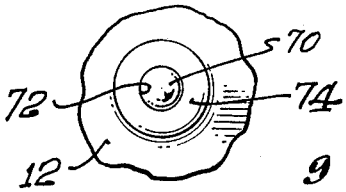
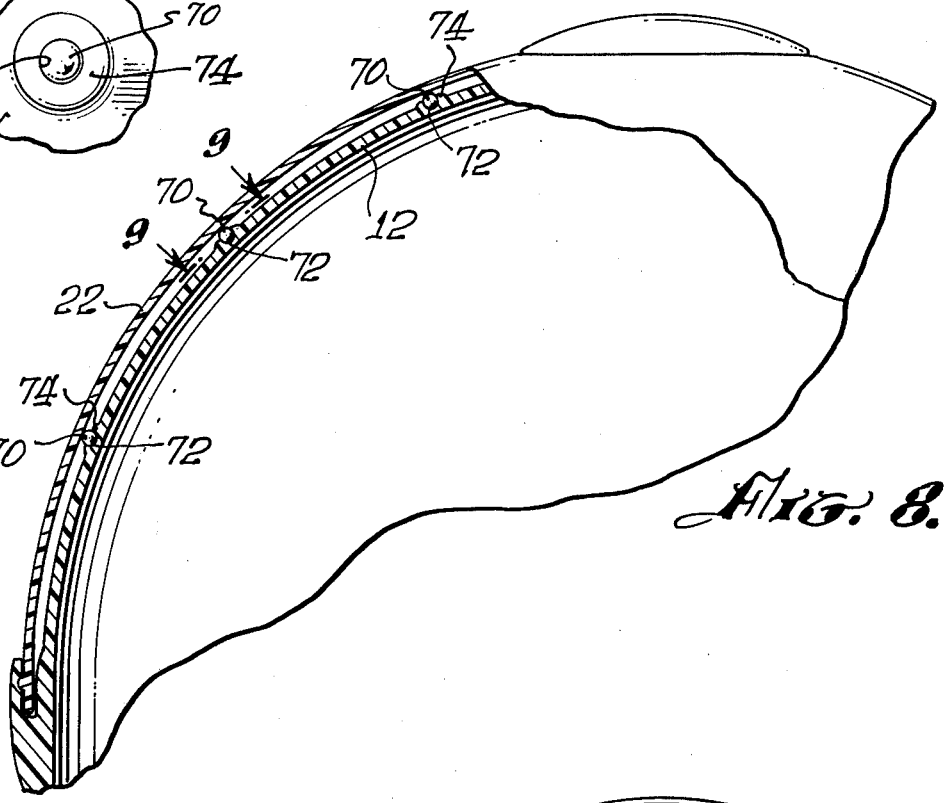
FIG. 8.
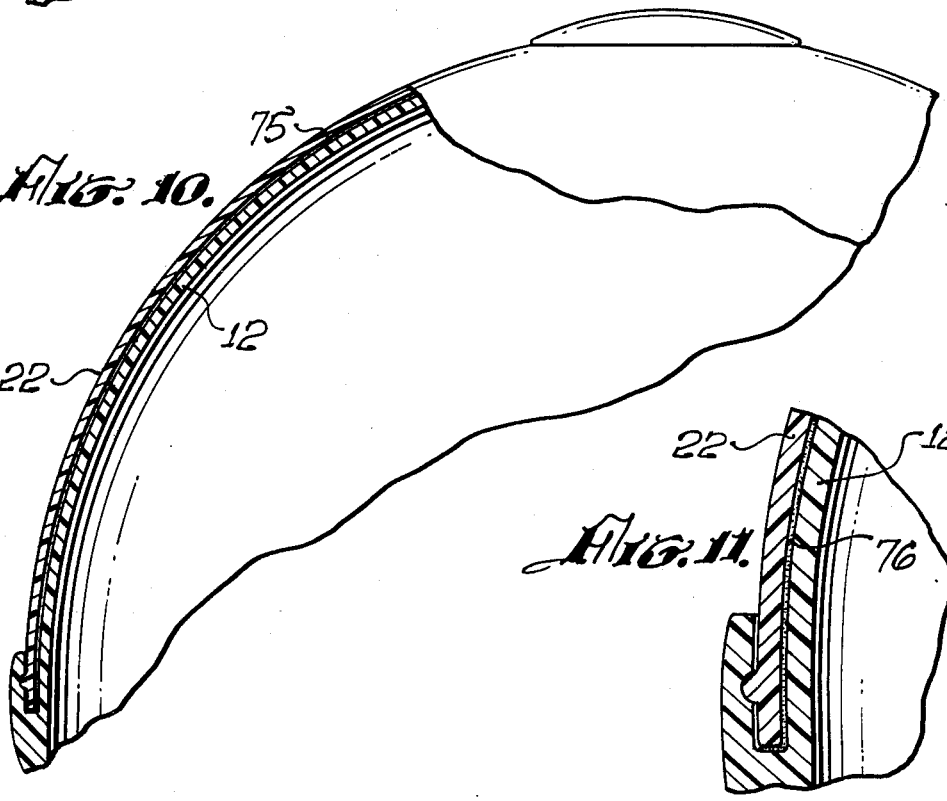
FIG. 10.
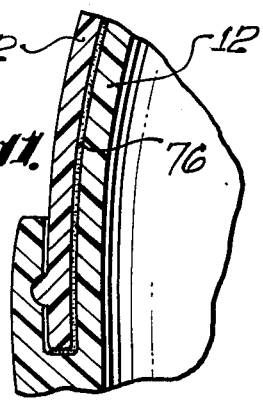
FIG. 11.

IMPACT-ABSORBING HELMET

BACKGROUND

1. Field of the Invention

This invention relates in general to a protective head gear such as a helmet and more particularly to a helmet having an impact-absorbing, rotatable, outer, shell member.

2. Description of the Prior Art

As is well known in the art, various types of protective head gear are presently available. These units now available, however, are associated with several problems and difficulties. Most helmets are designed to absorb shock; and this is generally accomplished by the use of inner protective linings. Thus, the force received by the helmet must be dissipated throughout the entire helmet and, hopefully, absorbed by various pads or straps, as known in the art.

These paddings are adapted to fit snugly around the head, face, and around the lower rear portion of the wearer's head. Such helmet structures have been designed for the purpose of protecting the wearer's head against injuries, but in reality, such helmet structures do not fully accomplish their designed purpose —because, although the upper section of such helmets are kept away from direct contact with the wearer's head, the shock of the blow received by the skull of the helmet is transferred into the portions fitting snugly against the face and the rear portion of the wearer's head, whereby the shock thereof is transferred therethrough and affects the wearer's head to a great extent.

Therefore, while the wearer's head may, to some extent, be protected against a direct hit or blow, the head as a whole is not at all protected against the effect of such a hit or blow, which could prove fatal to the wearer — or, otherwise, cause serious injuries as a result thereof.

SUMMARY

This invention provides a helmet having an outer, rotatable, protective shell whereby the outer shell is attached to an inner shell for relative annular rotation thereto. That is, the inner shell is integrally formed as the basic stationary unit in which the wearer's head is received, as in any typical helmet.

The outer shell is formed to be superposed over the inner shell and held thereon by a central fastening means which also provides vertical pivoting means. Annully disposed about the pivot means is a first bearing means in the form of ball bearings positioned in an annular raceway arranged in the inner shell, the central portion of the outer shell resting on the ball bearings. A second bearing means is arranged to be sandwiched between the inner and outer shells.

The second bearing means comprises a plurality of equally-spaced-apart bearing groups, the groups depending downwardly from the first center bearing means. Each group of bearings comprises a plurality of bearing members affixed to an axial connector, the bearing being rotatable about the axis of the connector, but held from longitudinal movement thereof by retaining means such as terminators or clips disposed on both sides of each bearing member.

Accordingly, the outer shell is supported by the first and second bearing means and, therefore, allows the outer shell to freely rotate about the central axis of the helmet.

The lower, annular, free edge of the outer shell is adapted to be received within a corresponding annular channel formed at the junction of the inner shell to that of the base member. Hence, the two shells are held in a stabilized relationship to each other at all times under whatever form of external impact to the helmet.

Thus, if an object impacts at any tangential point on the outer shell, the shell will immediately rotate about the stationary portion of the helmet, thereby completely dissipating the forces generated by the impact.

It is contemplated that any well known plastic, metal, rubber, or combination thereof can be used in the construction of the applicant's device. In addition a variety of well known paddings or safety straps can be installed within the inner shell to provide the wearer not only protection, but also comfort heretofore unobtainable in a safety helmet.

An alternative arrangement is contemplated, wherein the bearing means disposed between each shell comprises a lubricant material of either the wet or dry type. Thus, a lubricating film is provided in the space between each shell and held therein by the overlapping of the base member with respect to the annular edge of the rotatable shell.

OBJECTS AND ADVANTAGES OF THE INVENTION

The present invention has for an important object a provision whereby an impact-absorbing helmet includes an outer, freely-rotatable shell that will completely dissipate any tangential blows received thereto, thereby eliminating the need for specially-designed, inner protective paddings.

It is another object of the invention to provide an impact-absorbing helmet having a rotatable, outer shell superposed over a stationary shell, wherein bearing means are sandwiched therebetween.

It is still another object of the invention to provide an impact-absorbing helmet that is compatible and easily utilized in connection with various types of helmets such as helmets used by the armed forces, workmen's helmets, miners' helmets—as well as helmets used in athletics, including baseball, as well as football.

It is a further object of the present invention to provide an impact-absorbing helmet that is simple and rugged in construction.

A still further object of the invention is to provide a device of this character having a relatively-long, working life.

It is still another object of this invention to provide a device of this character that is inexpensive to manufacture.

The characteristics and advantages of the invention are further sufficiently referred to in connection with the accompanying drawings, which represent one embodiment. After considering this example, skilled persons will understand that variations may be made without departing from the spirit and scope thereof or sacrificing its material advantages, the arrangement herein before described being merely by way of example, and I do not wish to be restricted to the specific form shown or uses mentioned, except as defined in the accompanying claims.

DESCRIPTION OF THE DRAWINGS

Referring more particularly to the accompanying drawings, which are for illustrative purposes only:

FIG. 8 is a cross-sectional view similar to FIG. 2, however the bearing means is shown in a different arrangement support directly by the helmet;

FIG. 9 is an enlarged plan view taken along line 9—9 of FIG. 8;

FIG. 10 is another embodiment of a bearing means interdisposed between the outer and inner shells of the helmet; and FIG. 11 is an enlarged sectional illustrating the lubricant sealing means.

DESCRIPTION OF THE PREFERRED EMBODIMENT

Figures 1, 2, 3, 4, 5, 6, 7:
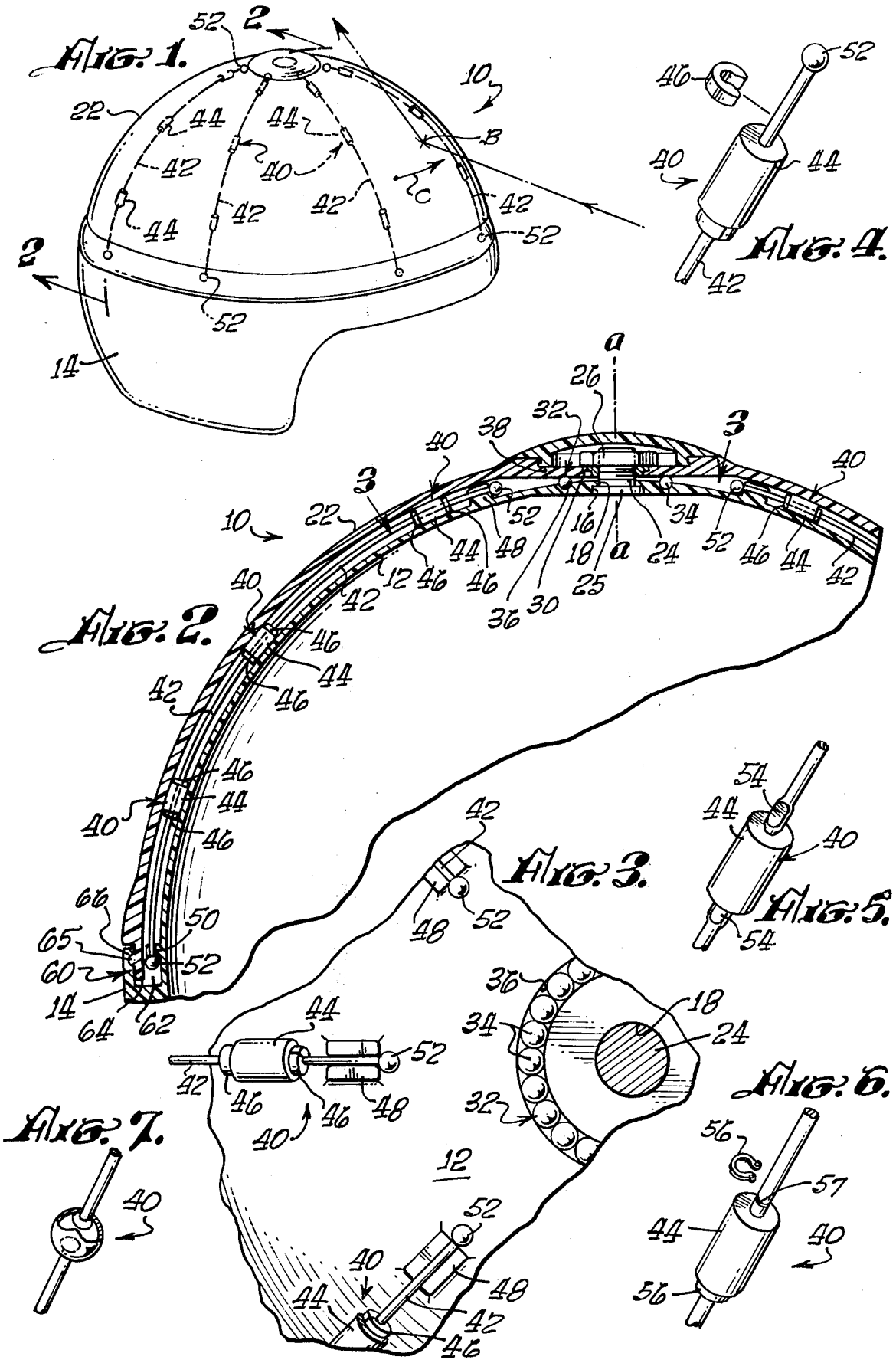
FIG. 1 is a perspective view of the present impact-absorbing helmet wherein the bearing means are shown in dotted lines.
FIG. 2 is an enlarged, cross-sectional view taken substantially along line 2—2 of FIG. 1.
FIG. 3 is a cross-sectional view taken substantially along line 3—3 of FIG. 2.
FIG. 4 is a perspective view of the end portion of the bearing means, showing one method of locating the bearing roller on the bearing axial-support member.
FIG. 5 is an alternative arrangement for locating the bearing longitudinally along the bearing axial-support member.
FIG. 6 is another arrangement for positioning the bearing by means of a removable clip.
FIG. 7 is a perspective view showing a ball-type bearing that is contemplated for use between the outer and inner helmet shells.

Referring more particularly to the drawings, there is shown in FIG. 1 an impact-absorbing helmet, generally indicated at 10, said helmet may be constructed of any desirable material such as plastic, metal, rubber, or the combination of these, wherein the helmet can be suitably formed or shaped to meet the necessary requirements for making a helmet of this type.

As herein illustrated, the helmet 10 comprises an inner shell member 12 having a typical configuration to receive an individual's head therein, said shell being integrally formed with a base member 14, as seen in FIG. 2.

Centrally disposed within the uppermost dome portion of the inner shell is an enlarged bore 16 followed by a reduced-diameter bore 18. Adapted to be received within the respective bores 16 and 18 is a pivot means, generally designated at 20. Said pivot means also provides an attachment means for the rotatable, outer, helmet shell 22.

Various pivot means have been contemplated; however, the unit 20 as herein shown comprises a bolt 24 having a head 25, wherein said head is positioned in bore 16 as the bolt is received through bore 18. The bolt is then received through the outer shell 22, whereby the outer shell 22 is held in a superposed, rotatable position relative to the substantially stationary inner shell 12 by nut 26. Accordingly, the outer shell 22 includes an opening 28 through which bolt 24 may be directly received —or, as shown, be provided with a bushing 30.

However, prior to covering the inner shell 12 with the outer shell 22 various bearing means are mounted to the inner shell 12. These bearing means included a first and second bearing means wherein the first bearing means, indicated generally at 32, comprises a plurality of ball bearings 34 received in an annular raceway 36 formed in the crown portion of inner shell 12. Hence, the crown portion of the outer shell 22 includes a lower, flat, bearing surface 38 which is allowed to rest upon the ball bearing 34, whereby said bearings are interposed therebetween.

A second bearing means, generally indicated at 40, comprises a plurality of bearing units, wherein each bearing unit extends radially outwardly starting from the crown portions of the shells and terminating adjacent the lower free end of shell 22 and the junction of shell 12 with the base member 14, as indicated in FIG. 2.

Each bearing unit comprises a bearing support means defined by an elongated, axial, connector wire 42, said wire being formed from a small-diameter, high-tensile-strength, hardened wire.

Adapted to be received and positioned on the bearing-support wire 42 are a plurality of roller bearings 44. These bearings are equally spaced apart from each other and held from longitudinal movement on the wire 42 by fastener means, which in this particular illustration are represented as crimp shoes 46, as seen in FIGS. 2 and 4. Shoes 46 are similar to split washers of a soft material that are disposed adjacent each end of a roller bearing and then crimped into place, thereby holding the respective bearing in its proper location. Other alternative bearing-support means will hereinafter be described.

To secure each bearing unit in its proper relationship between the two shells there is provided bearing-coupling means which comprise a plurality of keepers 48 and 50. Keepers 48 are integrally formed in inner shell 12 adjacent the first bearing means 32, and keepers 50 are integrally formed along the bottom of shell 12, wherein each keeper 48 is aligned with a respective keeper 50. Thus, the terminating ends of the wire 42 are received and held within each keeper 48 and 50, respectively, as seen in FIG. 2. However, to prevent longitudinal movement of each bearing unit, the terminating ends of the support wires 42 are adapted with shoe mounts 52.

As previously mentioned, various other arrangements are contemplated to position the free-rolling bearing 44 on the support wires. Thus, in FIG. 5, the support wire is shown wherein the wire itself is crimped at 54, forming a flat shoulder. In FIG. 6, the roller 44 is held in place by a pair of split washers 56 wherein each is received in an annular groove 57.

However, a different embodiment of a bearing is shown in FIG. 7 wherein the bearing resembles a ball bearing having the wire ends secured therein. Finally a stabilizing means generally indicated at 60, is included in the helmet, whereby the outer shell is held for a true rotation about axis *a—a*. The stabilizing means comprises an annular channel 62 formed at the junction of the base member 14 and inner shell 12, wherein the annular free edge 64 of the outer shell 22 is movably received therein.

The free edge 64 also includes an annular rib member 65 formed to fit within a matching annular groove 66 located in channel 62 of the base member 14. Thus, lateral movement of the outer shell 22 is prevented and, therefore, all impingement of foreign objects against the outer shell will cause rotation thereto in one direction or the other. As an example, see FIG. 1, wherein an impact when occuring at point "B" will cause shell 22 to rotate about axis *a—a* in the direction of arrow "C".

It should be noted at this time that safety padding and/or straps are not shown in the accompanying drawings, as various well-known types can be accommodated therein.

Still a further alternative arrangement of the ball-type bearing means is illustrated in FIGS. 8 and 9, wherein individual ball bearings 70 are inserted into evenly space cavities 72. The cavities include an annularly formed lip 74 which extend outwardly from the inner shell 12, whereby said lip engages the ball bearing 70 above the center line thereof. This allows the bearing 70 to be snaped into cavity 72 and held freely therein without fear the bearings will disengage therefrom due to the smaller diameter of the annular lip to that of the diameter of the bearing 70.

It is also contemplated that another arrangement such as shown in FIGS. 10 and 11 can be constructed. However, the bearing means in this embodiment is formed by a stationary shell 12 and the outer rotatable shell 22. The lubricant can be of any suitable type either liquid or the dry powered lubricant as shown in FIG. 11. However, the stabilizing means 60 as previously described provides a sealing means for sealing the lubricant therein and yet allows the shell 22 to freely rotate under impact.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. An impact-absorbing helmet comprising:

an inner, substantially-stationary, shell member;

a base member integrally formed as the lower, protective portion of said helmet;

an outer shell member rotatably supported on said inner shell and superposed thereover, said outer shell having an annular free edge;

means for attaching said outer shell to said inner shell about the central, vertical axis of said helmet;

pivot means disposed between said outer and inner shells in alignment with said vertical axis, whereby said outer shell freely rotates about said inner shell;

bearing means interdisposed between said outer and inner shells;

wherein said bearing means includes;

a first bearing means disposed between said outer and inner shell members, and annularly positioned about said attaching and pivot means; and a second bearing means disposed between said outer and inner shell members, wherein said second bearing means comprises a plurality of bearing units equally spaced apart in a side-to-side relation to each other, and wherein each bearing unit is arranged perpendicular to said base member; and means to stabilize the rotational movement of said outer shell with respect to said inner shell, said means being formed between said outer shell and said base member.

2. An impact-absorbing helmet as recited in claim 1, wherein said helmet includes a bearing coupling means wherein each of said bearing units are removably coupled to said inner shell, whereby said units are held in said perpendicular arrangement.

3. An impact-absorbing helmet as recited in claim 2, wherein each of said bearing units comprises:

a bearing-support means defined by an elongated, axial, connector wire;

a plurality of roller bearings positioned longitudinally along said wire; and a shoe mount affixed to each terminated end of said connector wire for coupling said bearing unit to said coupling means, and wherein said bearing unit is prevented from both lateral and longitudinal movement.

4. An impact-absorbing helmet as recited in claim 3, wherein said bearing coupling means comprises a plurality of keepers integrally formed in said inner shell and arranged thereon to receive each terminating end of said connector wire of said bearing units.

5. An impact-absorbing helmet as recited in claim 4, wherein said bearing units include a bearing fastener means, whereby said roller bearings are held in equal, longitudinal, spaced relation to each other along said axial connector wire.

6. An impact-absorbing helmet as recited in claim 5, wherein said bearing fastener means comprises a pair of crimp shoes, each of which is positioned on opposite sides of each roller bearing and affixed to said connector wire.

7. An impact-absorbing helmet as recited in claim 1, wherein said stabilizing means comprises an annular channel formed in said base member, said channel being arranged to freely receive said annular free edge of said outer shell for rotational movement therein, whereby lateral movement of said outer shell is restricted.

* * * * *